United States Patent [19]

Dien et al.

[11] Patent Number: 5,002,586

[45] Date of Patent: Mar. 26, 1991

[54] DYEING AND PRINTING OF LEATHER

[75] Inventors: Michel Dien, Rixheim, France; Willi Egli, Reinach, Switzerland

[73] Assignee: Sandoz Ltd., Basel, Switzerland

[21] Appl. No.: 229,034

[22] Filed: Aug. 5, 1988

[30] Foreign Application Priority Data

Aug. 8, 1987 [DE] Fed. Rep. of Germany ..... 3726491

[51] Int. Cl.[5] ..... D06P 3/32

[52] U.S. Cl. ..... 8/437; 8/436

[58] Field of Search ..... 8/536, 543, 556, 436, 8/437; 528/233

[56] References Cited

U.S. PATENT DOCUMENTS

| | | | |
|---|---|---|---|
| 4,425,133 | 1/1984 | Puntener | 8/115.6 |
| 4,427,411 | 1/1984 | Puntener | 8/404 |
| 4,452,602 | 6/1984 | Puntener et al. | 8/404 |
| 4,453,942 | 6/1984 | Puntener et al. | 8/404 |
| 4,507,124 | 3/1985 | Puntener et al. | 8/437 |

FOREIGN PATENT DOCUMENTS

| | | |
|---|---|---|
| 151370 | 8/1985 | European Pat. Off. . |
| 2163760 | 3/1986 | United Kingdom . |

*Primary Examiner*—Paul Lieberman
*Assistant Examiner*—John F. McNally
*Attorney, Agent, or Firm*—Gerald D. Sharkin; Richard E. Vila; Thomas C. Doyle

[57] ABSTRACT

A process for the dyeing or printing of leather with anionic metal complex dyes wherein the metal complex dyes are metal complexes of metallizable monoazo dyes or metallizable monoazomethine dyes or both metallizable monoazo and monoazo methine dyes and before the application of the dye or after the application of the dye or both before and after the application of the dye the leather is treated with a product (P) or a mixture of products (P) or an acid addition product thereof, product (P) being a polymer obtainable by reaction of ($\alpha$) a mono-functional or poly-functional amine containing one or more amino groups of the group consisting of primary, secondary and tertiary amino groups with ($\beta$) cyanamide, dicyanodiamide, guanidine or biguanide or a mixture in which up to 50 mole percent of the cyanamide, dicyanodiamide, guanidine or biguanide are replaced by a di-carboxylic acid or a mono- or diester thereof with cleavage of ammonia or a further reaction product thereof with reactant ($\gamma$) selected from the group consisting of:

(1) ($\gamma_1$) a N-methylol derivative of a urea, a melamine, a guanamine, a triazine, a urone, a urethane or an acid amide, (2) ($\gamma_2$) an epihalohydrin or an epihalohydrin precursor, (3) ($\gamma_3$) formaldehyde or a formaldehyde yielding product, (4) ($\gamma_2$) followed by ($\gamma_1$) and (5) ($\gamma_3$) followed by ($\gamma_1$).

41 Claims, No Drawings

DYEING AND PRINTING OF LEATHER

The invention provides a process for the dyeing or printing of leather with anionic metal complex dyes wherein the metal complex dyes are metal complexes of metallizable mono-azo dyes or metallizable monoazomethine dyes or both metallizable monoazo and monoazomethine dyes and before the application of the dye or after the application of the dye or both before and after the application of the dye the leather is treated with a product (P) or a mixture of products (P) or an acid addition product thereof, the product (P) being a polymer obtainable by reaction of ($\alpha$) a mono-functinal or poly-functional amine containing one or more amino groups of the group consisting of primary, secondary and tertiary amino groups with ($\beta$) cyanamide, dicyanodiamide, guanidine or biguanide or a mixture in which up to 50 mole percent of the cyanamide, dicyanodiamide, guanidine or biguanide are replaced by a di-carboxylic acid or a mono or diester thereof with cleavage of ammonia or a further reaction product thereof with reactant ($\gamma$) selected from the group consisting of:

(1) ($\gamma_1$) a N-methylol derivative of a urea, a melamine, a guanamine, a triazine, a urone, a urethane or an acid amide, (2) ($\gamma_2$) an epihalohydrin or an epihalohydrin precursor, (3) ($\gamma_3$) formaldehyde or a formaldehyde-yielding product, (4) ($\gamma_2$) followed by ($\gamma_1$) and (5) ($\gamma_3$) followed by $\gamma_1$).

If desired a subsequent cross-linking of N-methylol compounds may be carried out in the presence of a catalyst K.

Any kind of tanned leather commonly used as a substrate for dyeing from aqueous media may be used for the process of the invention, particularly grain leather (e.g. nappa from sheep, goat or cow and box leather from calf or cow), suede leather (e.g. velours from sheep, goat or calf and hunting leather), split velours (e.g. from cow or calf skin), buckskin and nubuk leather; further also wool-bearing skins and furs (e.g. fur-bearing suede leather). The leather may have been tanned by any usual tanning method, in particular vegetable, mineral, synthetic or combined tanned (e.g. chrome tanned, zirconyl tanned, aluminium tanned or semichrome tanned). If desired, the leather may also be retanned and/or fatted; for retanning, there may be used any tanning agent conventionally employed for retanning, e.g. mineral, vegetable or synthetic tanning agents [e.g. chromium, zirconyl or aluminium derivatives, oak, quebracho, chestnut or mimosa extract, aromatic syntans, copolymers of (meth)acrylic acid compounds or urea/formaldehyde resins].

A fatting step may, if desired, be carried out before, and/or after the treatment with the product (P). For fatting there may be used conventional fatting agents (in particular fat-liquoring agents), preferably from aqueous medium. Such fatting agents include animal, vegetable or mineral fats, oils, resins or waxes and/or their chemical modification products, e.g. hydrogenation, oxidation, saponification, trans-esterification or sulphonation products of animal or vegetable fats and oils, or chlorination and/or sulphonation products of mineral fats or oils, and synthetic fatting agents; neutralization agents may also be employed. For fat-liquoring there are preferably employed aqueous fat-liquor emulsions, in which the fat-liquor is emulsified by means of an emulsifier and/or by chemical modification. Fatting agents and emulsifiers are described e.g. in F. Stather "Gerbereichemie und Gerbereitechnologie", Akademie-Verlag, Berlin, 1967, 4th edition. By the term "sulphonation" for the fatting agents, there is meant generally the introduction of a sulpho group, including also the formation of a sulphato group (="sulphating") and the introduction of a sulpho group by reaction with a sulphite or $SO_2$ (="sulphiting").

The leathers may be of various thicknesses, thus there may be used very thin leathers such as bookbinders' leather or glove leather (nappa), leather of medium thickness such as shoe upper leather, garment leather and leather for handbags, or also thick leathers such as shoe sole leather, furniture leather, leather for suitcases, for belts and for sport articles; hair-bearing leathers and furs may also be used.

A pretreatment with the product (P) may also be carried out in the presence of a fatting agent.

The leather employed for the treatment with the product (P) may advantageously have been previously treated with conventional leather-treating agents. These leather treating agents may, however, also be used after a pre-treatment with a product (P) or for the treatment of a dyed leather that has been after-treated with a product (P). The leather that has been pre-treated with a product (P) may be intermediately dried before the dyeing or printing or may be used in the wet state for dyeing or printing. Similarly a dyed or printed leather may be intermediately dried and then treated with a product (P) or may be used in the wet state for after-treatment with the product (P).

Preferred metal complex dyes for the dyeing process of the invention contain at least one hydrosolubilizing acid group or sulphonic acid amide group, more preferably 2–8 and in particular 2–4 of such hydrosolubilizing groups in the molecule. The molecular weight of the metal complex dyes is preferably of at least 800. The dyes are preferably in the form of their 1:1- or 1:2-metal complexes, in particular chromium, cobalt, iron or copper complexes, principally in the form of 1:2-cobalt or -iron complexes, 1:1-copper complexes and 1:2-chromium complexes optionally in admixture with the corresponding 1:1-chromium complexes. Of the above, the cobalt and chromium complexes are preferred.

The dyes to be used according to the process of the invention are advantageously 1:2-metal complex dyes which preferably correspond to the formula

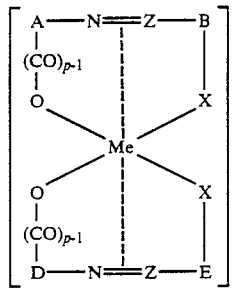

(I)

wherein each Z independently is nitrogen or a CH-group, each A and D independently is a radical of a compound of the benzene or naphthalene series containing a hydroxy or carboxy group in ortho position to the azo or azomethine group, each B and E independently signifies the radical of a coupling component when Z is nitrogen, X being in ortho or α-position to the azo group, or the radical of an o-hydroxyaldehyde when Z is the group CH, each X independently signifies oxygen or a group of formula —NR—, R being hydrogen or $C_{1-4}$-alkyl, Me signifies chromium or cobalt, each Y independently is a group of formula $—SO_3H$, —COOH or $—PO_3H_2$, p signifies 1 or 2 and n signifies a number from 1–6.

The dyes are of anionic nature and are preferably used in the form of their salts, in particular alkaline metal salts, principally lithium, potassium or sodium salts, or ammonium salts. Ammonium salts include also salts of organic amines, e.g. such that are substituted with $C_{1-6}$-alkyl or hydroxy-$C_{2-6}$-alkyl groups.

The dyes of formula (I) may be symmetrical or asymmetrical 1:2-azo complexes or 1:2-azomethine complexes or 1:2-complexes that contain one azo and one azomethine dye bound to the metal.

X is preferably oxygen.

When n is a number >1 the groups Y may have the same significance or different significances, i.e. the dyes may contain sulphonic acid groups and/or carboxylic acid groups and/or phosphonic acid groups. Preferably, however, all the symbols Y signify the sulpho group.

In the dyes of formula (I) p is preferably 1 and n is preferably 1–3, more preferably 2.

Preferably the metal-complex dyes of formula (I) contain 24–40 carbon atoms.

The molecular weight of the 1:2-metal-complex dyes of formula (I) is preferably in the range of 800–1000 (calculated as the free acid).

The radicals A and D may contain one or more carboxylic acid, phosphonic acid or sulphonic acid groups and also be further substituted, in particular with $C_{1-4}$-alkyl or -alkoxy, chloro or nitro.

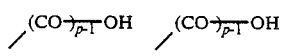

Suitable diazo components $A-NH_2$ and $D-NH_2$ include: anthranilic acid, 4- or 5-sulphoanthranilic acid, 2-amino-1-hydroxybenzene, 4-chloro- and 4,6-dichloro-2-amino-1-hydroxybenzene, 4- or 5-nitro-2-amino-1-hydroxybenzene, 4-chloro- or 4-methyl-6-nitro-2-amino-1-hydroxybenzene, 4-chloro-4-nitro-2-amino-1-hydroxybenzene, 4-cyano-2-amino-1-hydroxybenzene, 4-methoxy-2-amino-1-hydroxybenzene, 4-methoxy-5-chloro-2-amino-1-hydroxybenzene, 4-methyl-2-amino-1-hydroxybenzene, 4-chloro-5-nitro-2-amino-1-hydroxybenzene, 3,4,6-trichloro-2-amino-1-hydroxybenzene, 4,6-dinitro-2-amino-1-hydroxybenzene, 2-amino-1-hydroxybenzene-4- or 5-sulphonic acid, 4-nitro-2-amino-1-hydroxybenzene-6-sulphonic acid, 5-nitro- or 6-nitro-2-amino-1-hydroxybenzene-4-sulfonic acid, 6-chloro-2-amino-1-hydroxybenzene-4-sulphonic acid, 4-chloro-2-amino-1-hydroxybenzene-6-sulphonic acid, 1-amino-2-hydroxynaphthalene-4-sulphonic acid, 1-amino-2-hydroxy-6-nitronaphthalene-4-sulphonic acid, 2-amino-1-hydroxybenzene-4,6-disulphonic acid or 1-amino-2-hydroxybenzene-4-sulphonic acid amide.

When A and D are radicals of the benzene series they are preferably the radical of a 1-hydroxy-2-amino-benzene which is unsubstituted or is substituted by one or more substituents selected from the group consisting of nitro, sulpho, chloro, methyl and methoxy, of which nitro, chloro and sulpho are preferred, more preferably the radical of a 1-hydroxy-2-amino-benzene, bearing a nitro group or a chlorine atom in the 4- or 5-position, or the radical of a 1-hydroxy-2-amino-benzene bearing a nitro group or chlorine atom in the 4-position and a sulpho-group in the 6-position, or the radical of a 1-hydroxy-2-amino-benzene bearing a sulpho-group in the 4-position and a nitro group or a chlorine atom in the 6-position.

When A and D independently are radicals of the naphthalene series, they are preferably radicals of 1-amino-2-hydroxynaphthalene-4-sulphonic acid or 1-amino-2-hydroxy-6-nitronaphthalene-4-sulphonic acid.

When B and E independently are radicals of coupling components they are preferably derived from a coupling component selected from the group consisting of:

hydroxy- and/or amino-group-containing benzenes (wherein the amino group may optionally be acylated), particularly phenols that couple in ortho-position and may be substituted with low molecular alkyl or alkoxy, amino or acylamino, acylamino signifying $C_{1-4}$-alkanoylamino, $C_{1-4}$-alkylsulphony-amino, $C_{1-4}$-alkoxycarbonyl-amino, aroyl-amino or arylsulphonyl-amino, resorcinol or m-phenylene-diamine which is unsubstituted or substituted in the 4-position with sulpho, chloro, methyl or methoxy;

naphthols which may be further substituted with $C_{1-4}$-alkyl or -alkoxy, chloro, amino, acylamino or sulpho, acylamino having the same significance as indicated above, unsubstituted naphthols and sulpho-naphthols being preferred, in particular β-naphthol;

5-pyrazolones or 5-amino-pyrazoles that bear in the 1-position a phenyl or naphthyl radical, which may be unsubstituted or substituted with chloro, nitro, $C_{1-4}$-alkyl or -alkoxy or sulpho, and in the 3-position a $C_{1-4}$-alkyl group, in particular methyl;

acetoacetic acid amides, acetoacetic anilides and benzoylacetic acid anilides, in which the anilide-nucleus is either unsubstituted or substituted with chloro, $C_{1-4}$-alkyl or -alkoxy or sulpho;

6-hydroxy-3-cyano- or 6-hydroxy-3-carbamoyl-4-alkyl-2-pyridones, the 1-position of which is substituted by optionally further substituted $C_{1-4}$-alkyl, e.g. methyl, isopropyl, β-hydroxyethyl β-aminoethyl or γ-isopropoxy-propyl, or by unsubstituted phenyl, the alkyl in the 4-position being preferably a $C_{1-4}$-alkyl, in particular methyl.

Representative examples of these coupling components are: 2-naphthol, 1,3- or 1,5-dihydroxy-naphthalene, 1-naphthol, 1-acetylamino-7-naphthol, 1-propionylamino-7-naphthol, 1-carbomethoxyamino-7-naphthol, 1-carboethoxyamino-7-naphthol, 1-carbopropoxyamino-7-naphthol, 6-acetyl-2-naphthol, 2-naphthol-3-, -4-, -5-, -6-, -7- or -8-sulphonic acid, 1-naphthol-3-, -4- or -5-sulphonic acid, 1-naphthol-3,6-disulphonic acid, 1-naphthol-4,8-disulphonic acid, 1-naphthol-3,8-disulphonic acid, 2-naphthol-3,6-disulphonic acid, 4-methyl-1-naphthol, 4-methoxy-1-naphthol, 4-acetyl-1-naphthol, 5,8-dichloro-1-naphthol, 5-chloro-1-naphthol, 2-naphthylamine, 2-naphthylamine-1-sulphonic acid, 1-naphthylamine-4- or 5-sulphonic acid, 2-aminonaphthalene-6-or -5-sulphonic acid, 1-phenyl-3-methyl-pyrazole-5-one, 1-phenyl-5-pyrazolone-3-carboxylic acid amide, 1-(2'-, 3'- or 4'-methylphenyl)-3-methylpyrazol-5-one, 1-(2'-, 3'- or 4'-sulphophenyl)-3-methylpyrazol-5-one, 1-(2'-chloro-5'-sulphophenyl)-3-methylpyrazol-5-one, 1-(2'-or 4'-methoxyphenyl)-3-methylpyrazole-5-one, 1-(2'-, 3'- or 4'-chlorophenyl)-3-methylpyrazole-5-one, 1-(2'-, 3'-or 4'-nitrophenyl)-3-methylpyrazol-5-one, 1-(2',5'- or 3',4'-dichlorophenyl)-3-methylpyrazol-5-one, 1-(2',5'-dichloro-4'-sulphophenyl)-3-phenylpyrazole-5-one, 1-(2'-, 3'- or 4'-sulphophenyl)-3-methyl-5-aminopyrazole, 1-(2'-chloro-5'-sulphophenyl)-3-methyl-5-aminopyrazole, acetoacetic acid anilide, acetoacetic acid anilide2-, -3- oder -4-sulphonic acid, acetoacetic acid-o-anisidide, acetoacetic acid-o-toluidide, acetoacetic acid-o-chloroanilide, acetoacetic acid-m-xylidide, tetralol, 4-methylphenol, 3-dialkylaminophenol, in particular 3-dimethylamino- and 3-diethylaminophenol, 4-butylphenol, 4-amylphenol, in particular 4-t.amylphenol, 2-isopropyl-4-methylphenol, 2- or 3-acetylamino-4-methylphenol, 2-methoxycarbonylamino-4-methoxyphenol, 2-ethoxycarbonylamino-4-methylphenol, 3,4-dimethylphenol, 1-ethyl-3-cyano-4-methyl-6-hydroxypyridone, 1-methyl-3-cyano-4-methyl-6-hydroxypyridone and 1-phenyl-3-carbamoyl-4-methyl-6-hydroxypyridone.

Preferably B and E represent each the radical of a coupling component which is unsubstituted 2-naphthol, 2-naphthol substituted with a sulpho group, unsubstituted 1-phenyl-3-methyl-5-pyrazolone, unsubstituted acetoacetic acid anilide or 1-phenyl-3-methyl-5-pyrazolone or acetoacetic acid anilide, in which the phenyl ring is substituted with $C_{1-4}$-alkyl, $C_{1-4}$-alkoxy, chloro or sulpho.

When Z represents the group CH the corresponding radical B or E represents the radical of an o-hydroxyaldehyde, preferably the radical of an o-hydroxy benzaldehyde or o-hydroxy-naphthaldehyde. Suitable aldehydes include: 2-hydroxy-1-naphthaldehyde, 1-hydroxy-2-naphthaldehyde, 2-hydroxy-benzaldehyde, 3- and 5-methyl-2-hydroxybenzaldehyde, 3,5-dimethyl-2-hydroxybenzaldehyde, 5-butyl-2-benzaldehyde, 5-chloro- or 5-bromo-2-hydroxybenzaldehyde, 3-chloro-2-hydroxybenzaldehyde, 3,5-dichloro-2-hydroxybenzaldehyde, 5-sulpho-2-hydroxybenzaldehyde, 3-methyl-5-chloro-2-hydroxybenzaldehyde, 5-(phenylazo)-2-hydroxybenzaldehyde, 5-(2'-, 3'- or 4'-sulphophenylazo)-2-hydroxybenzaldehyde, or 5-(6'-sulphonaphthyl-1'-azo)-2-hydroxybenzaldehyde.

Preferably the 1:2-metal complexes contain two sulpho groups (Y=sulpho, n=2).

1:2-Metal complexes of monoazo compounds with two sulpho groups per metal complex molecule, in particular with one sulpho group in each azo complexant are particularly preferred. Most preferred are the following dyes:

(a) yellow dyes of the formula

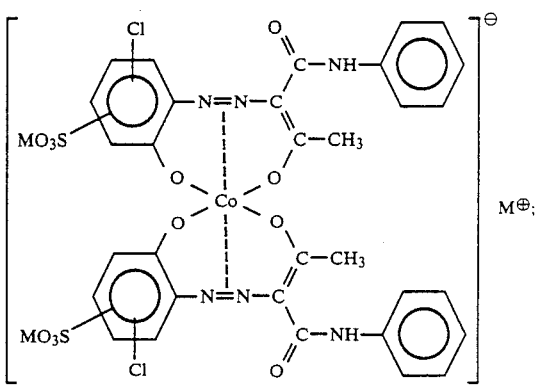

(II)

(b) red dyes of the formula

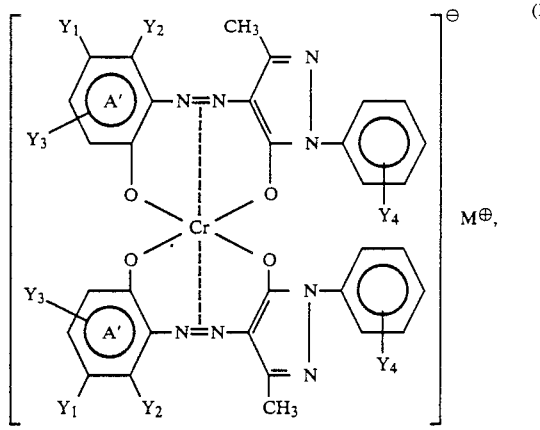

(III)

in which at the ring A' one of $Y_1$, $Y_2$ and $Y_3$ signifies chlorine, one signifies hydrogen and one signifies the group $—SO_3M$, or $Y_1$ and $Y_2$ together with the vicinal carbon atoms to which they are linked form a condensed benzo ring and $Y_3$ signifies a group $—SO_3M$ in para position to the azo group and $Y_4$ signifies hydrogen or chlorine;

(c) blue dyes of the formula

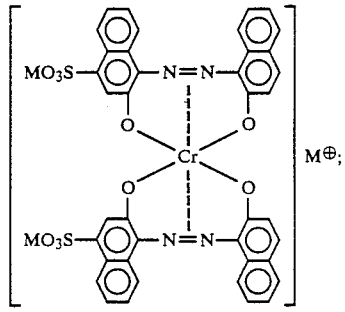

(IV)

(d) brown dyes which are mixed 1:2-chromium complexes of monoazo dyes of the formulae

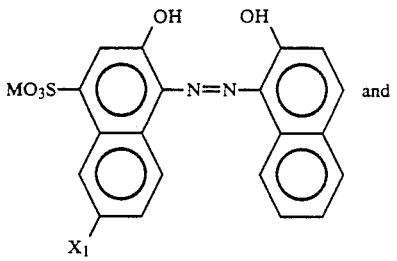

and (V)

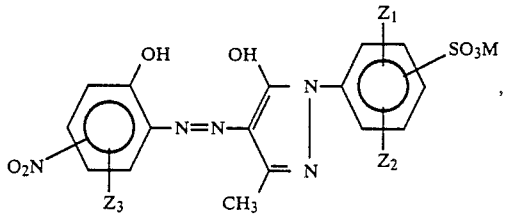

(VI)

wherein $X_1$ signifies hydrogen or $—NO_2$, $Z_1$ signifies hydrogen, chloro or methyl and $Z_2$ and $Z_3$ signify each hydrogen or chlorine, the purely asymmetrical complex representing at least 70 mole % of the mixed complex;

(e) black dyes which are chromium complexes of the monoazo dyes of the formula (V) in which $X_1$ signifies $—NO_2$;

in the formula (II) to (VI) M signifying hydrogen or a cation.

In the dyes (a) the chlorine atom in the diazo component is preferably in para-position to the oxygen and the sulpho group is preferably in ortho-position to the oxygen.

Of the dyes (b) the ones are preferred in which $Y_4$ is hydrogen, in particular bordeaux red dyes, in which $Y_1$ and $Y_2$ together with the carbon atoms to which they are linked form a condensed benzo ring and $Y_3$ is a sulpho group in para-position to the azo group, and medium red dyes in which $Y_1$ is chlorine, $Y_2$ is hydrogen and $Y_3$ is a sulpho group in ortho position to the oxygen.

In the dyes (d) $X_1$ is preferably the nitro-group and at least two of the symbols $Z_1$, $Z_2$ and $Z_3$ signify hydrogen, more preferably all three symbols $Z_1$, $Z_2$ and $Z_3$ signify hydrogen. The nitro group in formula (VI) is preferably in para-position to the hydroxy group; the sulpho group in formula (VI) may be in any of the positions ortho, meta or para to the pyrazolone ring and is more preferably in para position.

M may be any cation conventional in sulpho group-containing metal complexes, preferably unsubstituted or substituted ammonium (in particular ammonium substituted with $C_{1-4}$-alkyl and/or with $\beta$-hydroxy-$C_{2-3}$-alkyl, preferably mono-, di- or tri-ethanol- or -isopropanolammonium) or alkali metal (lithium, sodium, potassium), of which potassium and in particular sodium are preferred.

These dyes are known or may be produced in known manner, e.g. by metallisation of the corresponding metallisable mono-azo compounds.

They may be used in the form as has been synthesized and if necessary purified or, preferably, be blended with conventional blending agents (in particular with inorganic salts, preferably sodium carbonate, sulphate or chloride, with non-electrolyte blending agents, preferably dextrine and/or urea and optionally, for the production of granular or liquid forms, with corresponding suitable additives). The dyes may be used in any conventional form, e.g. as powder, liquid compositions or granules; for the production of especially electrolyte-poor compositions the dyes may be purified e.g. by dialysis before any blending with non-electrolyte blending agents.

The products (P) that are used in the process of the invention may be produced in conventional manner. The reaction of ($\alpha$) with ($\beta$) is carried out without any addition of water or of any other organic solvents and at temperatures >50° C., more preferably in the range of 60°-200° C., in particular of 80°-180° C. and with cleavage of ammonia. The molar ratio ($\alpha$)/($\beta$) is advantageously in the range of 0.75/1.25 to 1.25/0.75, preferably 1/1, component ($\beta$) being employed preferably in amounts of 0.1 to 1 moles per mole of reactive NH or $NH_2$ group in ($\alpha$). Preferably the reaction is carried out in the presence of a catalyst ($K_1$) which is advantageously a metal compound of a metal of the third or preferably second group of the periodic system of elements (principally aluminium, barium, magnesium or zinc). The metal compound is advantageously a hydrosoluble salt of a low molecular acid, preferably a mineral acid, in particular a chloride, especially zinc chloride. The catalyst ($K_1$) may also be an inorganic base or a heterocyclic base which is advantageously an amino-substituted pyridine, preferably a pyridine substituted by a tertiary amino group, in particular a dialkylamino group; the dialkylamino is preferably di-($C_{1-4}$-alkyl-)amino, more preferably dimethylamino; the most preferred heterocyclic base is 4-dimethylamino-pyridine. Of the above-mentioned catalysts the metal salts are preferred. ($K_1$ is advantageously employed in amounts of 0.01 to 10% by weight, referred to the sum [($\alpha$)+($\beta$)], the metal salts being employed preferably in amounts of 0.1 to 5% by weight, in particular 0.2 to 1% by weight and the heterocycles being employed in amounts of 0.1 to 7% by weight, in particular 4.5 to 5.5% by weight.

The reaction takes place with ammonia-cleavage and is suitably carried out until the ammonia development extinguishes. Advantageously the reaction is carried on until the product contains at least one free hydrogen atom bound to a nitrogen atom in the molecule.

The obtained product may if desired be protonated with an acid, preferably a mineral acid, more preferably hydrochloric acid or sulphuric acid, to the corresponding acid addition product or be further reacted with ($\gamma$) and then be protonated if desired.

A preferred polymer product (P) of the reaction of ($\alpha$) with ($\beta$) is in particular the reaction product of a monoamine of the formula $$NHRR \qquad \text{(VII)}$$

or a polyamine of the formula $$RRN—Z'—X_2)_tZ'—NRR \qquad \text{(VIII)}$$

wherein each R independently signifies hydrogen, $C_{1-4}$-alkyl or $C_{1-4}$-alkyl substituted with hydroxy, $C_{1-4}$-alkoxy, phenyl or cyano t is a number from 0 to 100 each Z' independently signifies a $C_{1-4}$-alkylene or hydroxy-alkylene radical and each $X_2$ signifies —O—, —S— or —NR— the amine of formula (VIII) containing at least one reactive NH or $NH_2$ group.

In the amines of formula (VIII) R signifies preferably hydrogen, t is preferably a number from 0 to 4, $X_2$ signifies —NH— or —$NCH_3$— and each Z' signifies $C_{2-4}$-alkylene.

Particularly preferred amines of the formula (VIII) are diethylenetriamine, triethylenetetraamine, tetraethylene-pentaamine, 3-(2-aminoethyl)-aminopropylamine, dipropylenetriamine or N,N-bis-(3-aminopropyl)-methylamine.

Component (β) is most preferably dicyanodiamide.

Compounds of the kind (P), their acid addition products and their production are described e.g. in German published patent applications DE 35 25 104 A1 (corresponding to GB 2 163 760 A and to U.S. Ser. No. 07/096,662, filed Sept. 15, 1987) and DE 32 16 913 A1 (corresponding to GB 2 099 007 A and to U.S. Pat. No. 4 439 203) and in PCT published patent application WO 81/02423 (corresponding to GB 2 070 006 B and to U.S. Pat. No. 4,410,652); the content of these patent specifications (before all of DE 35 25 104 A1) is incorporated herein by reference, in particular with regard to the production of the compounds (P) and their acid addition products, the employed starting materials, catalysts and acids, the production parameters and reaction conditions and the obtained products.

Before dyeing or printing the leather may be pretreated with products (P) (optionally in the form of their acid addition products) and dyeing or printing may then be carried out in conventional way, but according to a preferred feature, the treatment with the products (P) (optionally in the form of their acid addition products) is carried out after dyeing or printing.

In the pre-treatment of the undyed and unprinted leather or in the after-treatment of the dyed or printed leather, the product (P) (calculated as 100% active substance) is used in amounts in the range of 0.2 to 5% by weight, preferably 0.4 to 3% by weight, referred to the dry weight of the leather, or in amounts of 0.1 to 2.5% by weight, preferably 0.2 to 1.5% by weight, referred to the wet weight of the substrate. The pre-treatment of the leather with a product (P) is carried out advantageously in the pH range of 3 to 6, more preferably 4.5 to 5.0; the after-treatment with a product (P) of the dyed or printed leather is advantageously carried out at a pH in the range of 3 to 5, preferably 3 to 4.

The pre-treatment and after-treatment with product (P) is preferably carried out for 10–45 minutes.

The dyeing may be carried out under conventional conditions, preferably at temperatures in the range of 25°–70° C. and at pH values in the range of 3 to 9, more preferably 4 to 8, optionally in the presence of conventional dyeing assistants, e.g. of a dye-substantive uptake assistant, such as a highly oxyethylated and optionally quaternated fatty amine or fatty aminoalkylamine. After dyeing the pH of the dye bath is advantageously lowered, preferably to values in the pH-range of 3 to 5, more preferably 3.3 to 4; a fatting may advantageously be carried out subsequently to the dyeing.

The after-treatment of the dyeing with product (P) may take place in the same bath in which the dyeing has been carried out, advantageously at acidic pH-conditions, preferably in the range of pH 3 to pH 5, more preferably at pH-values ≦4, in particular at pH 3.3 to 4.

The after-treatment agent (P) is conveniently added to the dye bath which after the dyeing (if a fatting agent has been added, also after the addition of a fatting agent) has been acidified advantageously to pH-values ≦4, in particular to pH values in the range of 3.3 to 4.

The after-treatment may, however, also be carried out in a separate fresh bath, advantageously after having lowered the pH of the dye bath and then having drained off the dye bath. The pH of the fresh bath may range in any suitable scope, e.g. between pH 3 and pH 8, preferably in the pH-range of 3 to 6.5, depending on the pH of the employed product (P); a further acid addition in the fresh bath is in general not required since in this case the leather, when adding the fresh bath, is still soaked with the previous bath which is preferably acidic of pH <4.

The after-treatment is advantageously carried out in the same temperature range as the dyeing, any fatting and any lowering of the pH value by acid addition, preferably at temperatures in the range of 25°–70° C., more preferably 35°–60° C. for leather and 25°–55° C. for woolbearing skins.

The treated leathers may then be finished in conventional way.

By the process of the invention, there may be achieved a good buildup of the dyes on the leather and deep shades. The obtained dyeings are distinguished by their good fastnesses, principally light-fastnesses and wet-fastnesses, in particular fastness to sweat, to sea-water and to lake-water and their good shade-stability.

In the following Examples parts and percentages are by weight; the temperatures are indicated in degrees Celsius.

The percent indications refer to the dry weight of the substrates, if there is not clearly meant a concentration of a solution or dispersion. The products are employed in commercial form, the dye quantities are referred to the active substance.

EXAMPLE 1 (DRUM-DYEING)

Chrome-tanned intermediately dried nappa from sheep is wetted back with 600% of water and 1% of 25% ammonia for 60 minutes at 50°. The bath is then drained off and a fresh bath of 500% of water at 55°, 1% of 25% ammonia, 0.8% of vegetable fatty acids which are partially esterified with methyl (fatting agent) and 1.5% of the red dye of formula (III')

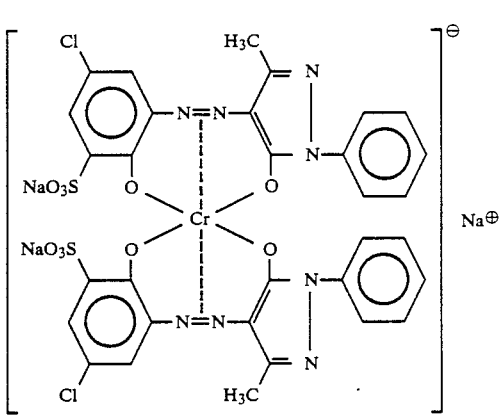

are added and dyeing is carried out for 50 minutes at 55°. 1% of 85% formic acid are then added and after 15 minutes further 0.8% of the dye of formula (III') are added and dyeing is continued for further 30 minutes at 55°. 2% of 85% formic acid are then added and the treatment is continued for further 40 minutes and the bath is then drained off. 600% of water at 50° C. and 3% of the aqueous reaction product of dicyanodiamide and diethylenetriamine (molar ratio 1/1) in the form of the sulphate according to Example 1 of German published patent specification DE 35 25 104 A1 (corresponding to GB 21 63 760 A) but of 55% concentration are then added and the after-treatment is carried out for 30 minutes at 50° C. The bath is then drained off and the leather is rinsed for 5 minutes in a running water of 25° C. The bath is then drained off, the leather is drained, dried and mechanically finished as conventional.

EXAMPLE 2 to 6

The process of Example 1 is repeated with the difference that in place of the red dye of formula (III') the following dyes are employed:

Example 2: the yellow dye of formula (II')

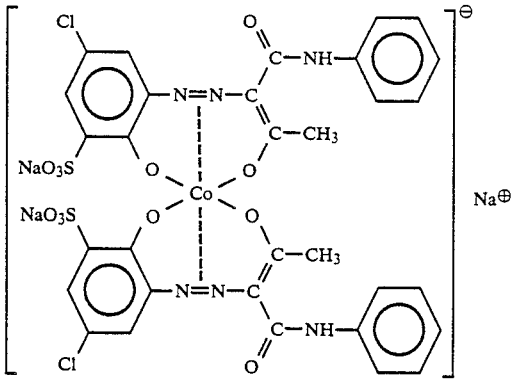

Example 3: the bordeaux-red dye of formula (III'')

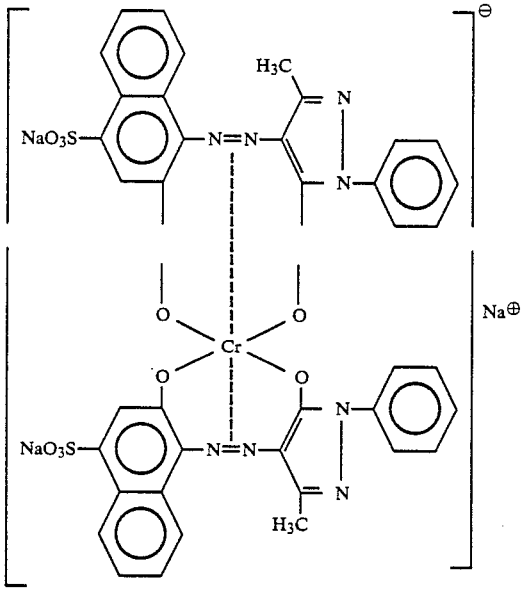

Example 4: the blue dye of formula (IV')

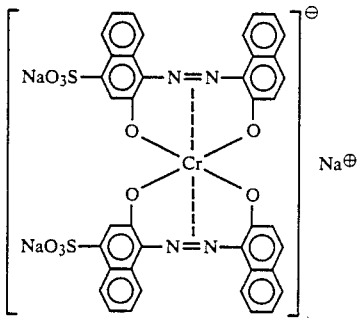

Example 5: the black dye of formula (V')

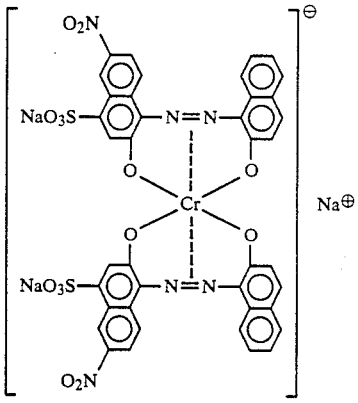

Example 6: the brown 1:2-chromium mixed complex of the mono-azo dyes of the formulae

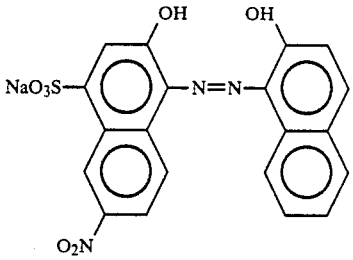

and (V'')

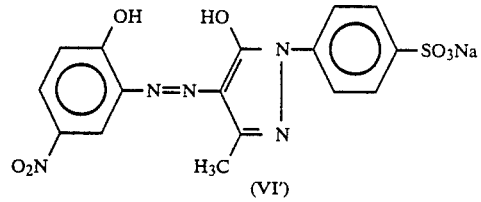

(VI')

in molar ratio 1/1.

EXAMPLE 7 (drum-dyeing)

Chrome-synthetically tanned and intermediately dried lamb-leather for gloves is wetted back with 1000% of water at 50°, 3% of 25% ammonia and 0.3% of the addition product of 10 moles of ethylene oxyde to 1 mole of di-t-butyl phenol for 60 minutes. The bath is drained off and the leather is washed for 10 minutes with 800% of water at 50°. The bath is then drained off.

900% of water at 50°, 2% of 25% ammonia and 3% of vegetable fatty acids that are partially esterified with methyl (fatting agent) are added and after 15 minutes of rotation 2.4% of the blue dye of formula (IV') are added in 3 portions and at intervals of 10 minutes. 30 minutes after the third dye-addition 5% of 85% formic acid are added also in 3 portions at intervals of 10 minutes (pH=3.5). 30 minutes after the third acid-addition the bath is drained off. 600% of water at 50° and 3% of the aqueous condensation-product of dicyanodiamide and diethylenetriamine (molar ratio 1/1) in the form of the sulphate according to Example 1 of DE 35 25 104 A1 (corresponding to GB 2 163 760 A) but of 55% concentration are added and after 30 minutes rotation the bath is drained off. After washing for 10 minutes with 800% of water at 25° the bath is drained off, the leather is drained, dryed and mechanically finished as conventional.

EXAMPLES 8 TO 12

The procedure of Example 7 is repeated with the difference that in place of the blue of formula (IV') the following dyes are added:

Example 8: the yellow dye of formula (II')

Example 9: the bordeaux-red dye of formula (III'')

Example 10: the red dye of formula (III')

Example 11: the black dye of formula (V')

Example 12: the brown 1:2-chromium complex dye of the monoazo dyes of formulae

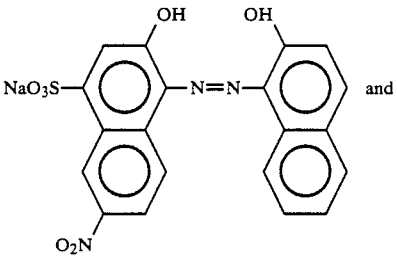

and (V'')

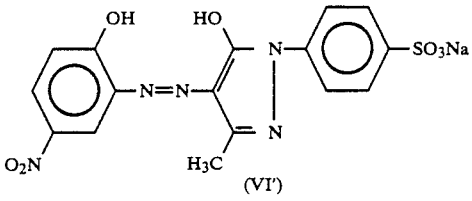

(VI')

in the molar ratio 1/1.

The obtained dyes are level intense and brilliant with optimum penetration and fastnesses, in particular wet-fastnesses.

What is claimed is:

1. A process for dyeing or printing leather with an anionic metal complex dye which comprises the steps of applying the dye to the leather and treating the leather, before and/or after application of the dye, with a product (P) or a mixture of products (P) or an acid addition product of product (P), said anionic metal complex dye being a dye of formula I'

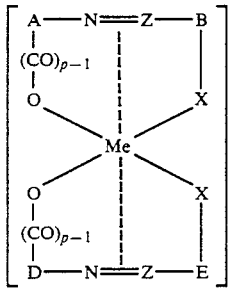

(I')

wherein each Z, independently, is nitrogen or a CH-group, each A and D, independently, is a radical of a compound of the benzene or naphthalene series containing a hydroxy or carboxy group in ortho position to the azo or azomethine group, each B and E independently, signifies the radical of a coupling component when Z is nitrogen, X being in ortho or α-position to the azo group, or the radical of an o-hydroxyaldehyde when Z is the group CH, each X, independently, signifies oxygen or a group of formula —NR—, R is hydrogen or $C_{1-4}$-alkyl, Me signifies chromium or cobalt, and p signifies 1 or 2, with the proviso that there are present a total of two groups selected from $—SO_3H$, —COOH and $—PO_3H_2$ or an alkali metal or ammonium salt thereof, and said product (P) being a polymer obtainable by reaction of (α) a mono-functional or poly-functional amine containing one or more amino groups of the group consisting of primary, secondary and tertiary amino groups, with (β) cyanamide, dicyanodiamide, guanidine or biguanide or a mixture in which up to 50 mole percent of the cyanamide, dicyanodiamide, guanidine or bisuanide are replaced by a di-carboxylic acid or a mono-diester thereof with cleavage of ammonia or a product of further reacting said polymer with reactant (γ) selected from the group consisting of:

(1) ($\gamma_1$) a N-methylol derivative of a urea, a melamine, a guanamine, a triazine, a urone, a urethane or an acid amide, (2) ($\gamma_2$) an epihalohydrin or an epihalohydrin precursor, (3) ($\gamma_3$) formaldehyde or a formaldehyde-yielding product, (4) ($\gamma_2$) followed by ($\gamma_1$) and (5) ($\gamma_3$) followed by ($\gamma_1$).

2. A process according to claim 1, wherein the product of the reaction of (α) with (β) is a product obtainable from the reaction in the presence of a catalyst ($K_1$).

3. A process according to claim 1, wherein (P) is the product of reacting (γ) with the product of reacting (α) with (β), the reaction product of (α) with (β) containing at least one free hydrogen-atom bound to a nitrogen atom.

4. A process according to claim 2, wherein (P) is a product of the reaction of (α) with (β).

5. A process according to claim 1, wherein the product (P), a mixture of such products (P) or an acid addition product thereof is used in amounts of 0.2% to 5% by weight (calculated as 100% non-protonated active substance) referred to the dry weight of the leather substrate, or in amounts of 0.1 to 2.5% by weight (calculated as 100% non-protonated active substance), referred to the wet weight of the leather substrate.

6. A process according to claim 1, wherein the leather is pre-treated with a product (P), a mixture of such products (P) or an acid addition product thereof at a pH in the range of 3 to 6, or is after-treated after the dyeing with a product (P), a mixture of such products (P) or an acid addition product thereof at a pH in the range of 3 to 5.

7. A process according to claim 1, wherein the pre-treatment or the after-treatment is carried out during 10 to 45 minutes.

8. A process according to claim 1, wherein the leather is fatted before the treatment with a product (P), a mixture of such products (P) or an acid addition product thereof.

9. A process according to claim 8, wherein the leather is after-treated with the product (P), a mixture of such products (P) or an acid addition product thereof, after the dyeing and a fatting is carried out after the dyeing and before the after-treatment.

10. Leather, treated by a process according to claim 1.

11. Leather, treated by a process according to claim 4.

12. A process according to claim 1 wherein formula I' contains two —$SO_3H$ groups.

13. A process according to claim 1, wherein ($\alpha$) is a monoamine of the formula $$NHRR \qquad (VII)$$

or a polyamine of the formula $$RRN—(Z'—X_2)_tZ'—NRR \qquad (VIII)$$

wherein each R independently signifies hydrogen, $C_{1-4}$-alkyl or $C_{1-4}$-alkyl substituted with hydroxy, $C_{1-4}$-alkoxy, phenyl or cyano, t is a number from 0 to 100, each Z' independently signifies a $C_{1-4}$-alkylene or hydroxy-alkylene radical and each $X_2$ signifies —O—, —S— or —NR—, the amine of formula (VIII) containing at least one reactive NH or $NH_2$ group and the mol ratio ($\alpha$):($\beta$) being in the range 0.75:1.25 to 1.25:0.75.

14. A process according to claim 13 wherein formula I' contains two —$SO_3H$ groups.

15. A process according to claim 13 wherein ($\alpha$) is selected from the group consisting of diethylenetriamine, triethylenetetramine, tetraethylenepentamine, 3-(2-aminoethyl)-aminopropylamine, dipropylenetriamine and N,N-bis(3-aminopropyl)-methylamine.

16. A process according to claim 14 wherein ($\alpha$) is selected from the group consisting of diethylenetriamine, triethylenetetramine, tetraethylenepentamine, 3-(2-aminoethyl)-aminopropylamine, dipropylene triamine and N,N-bis(3-aminopropyl)-methylamine and ($\beta$) is dicyandiamide.

17. A process according to claim 14 wherein, in formula I', each of A and D, independently, is a radical of 1-hydroxy-2aminobenzene which is unsubstituted or substituted by one or more substituents selected from nitro, sulpho, chloro, methyl and methoxy or of 1-amino-2-hydroxynaphthalene-4-sulphonic acid or 1-amino-2-hydroxy-6-nitronaphthalene-4-sulphonic acid and each of B and E, independently, is a coupling component selected from the group consisting of 2-naphthol which is unsubstituted or substituted with a sulpho group, 1-phenyl-3-methyl-5-pyrazalone which is unsubstituted or substituted on the phenyl ring with $C_{1-4}$-alkyl, $C_{1-4}$alkoxy, chloro or sulpho and acetoacetic acid anilide which is unsubstituted or substituted on the phenyl ring with $C_{1-4}$alkyl, $C_{1-4}$alkoxy, chloro or sulpho, or the radical of an o-hydroxybenzaldehyde or o-hydroxynaphthaldehyde.

18. A process according to claim 17 wherein ($\alpha$) is selected from the group consisting of diethylenetriamine, triethylenetetramine, tetraethylenepentamine, 3-(2-aminoethyl)-aminopropylamine, dipropylene triamine and N,N-bis(3-aminopropyl)-methylamine and ($\beta$) is dicyandiamide.

19. A process according to claim 16 wherein the anionic metal complex dye is selected from the group consisting of (a) yellow dyes of the formula

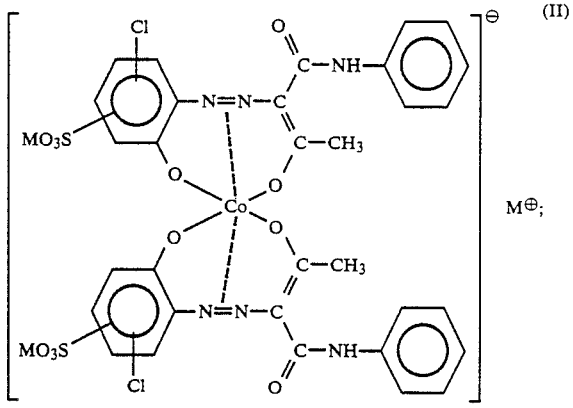

(II)

(b) red dyes of the formula

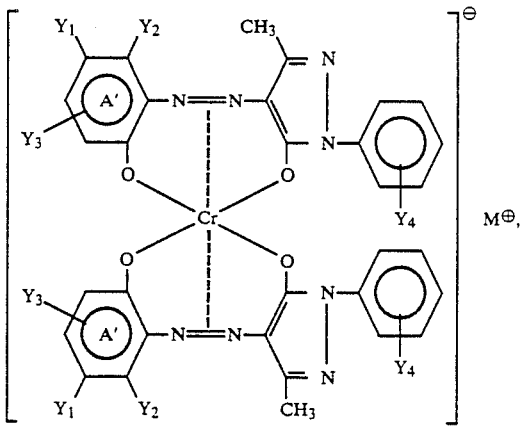

(III)

in which at the ring A' one of $Y_1$, $Y_2$ and $Y_3$ signified chlorine, one signifies hydrogen and one signifies the group —$SO_3M$, or $Y_1$ and $Y_2$ together with the vicinal carbon atoms to which they are linked form a condensed benzo ring and $Y_3$ signifies a group —$SO_3M$ in para position to the azo group and and $Y_4$ signifies hydrogen or chlorine;

(c) blue dyes of the formula

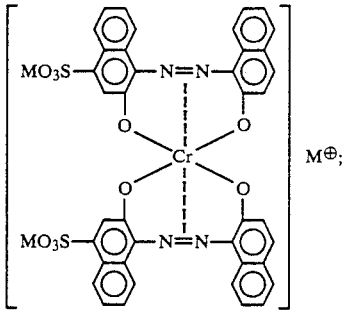

(IV)

(d) brown dyes which are mixed 1:2-chromium complexes of monoazo dyes of the formulae

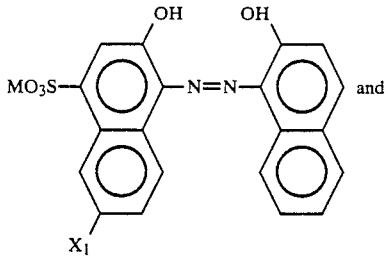

(V)

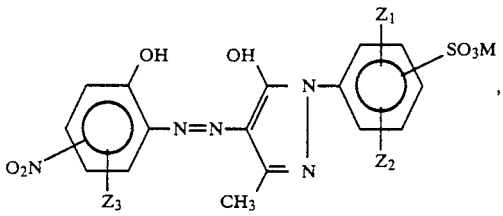

(VI)

wherein $X_1$ signifies hydrogen or —$NO_2$, $Z_1$ signifies hydrogen, chloro or methyl and $Z_2$ and $Z_3$ each signify hydrogen or chlorine, the purely asymmetrical complex representing at least 70 mole % of the mixed complex; and (e) black dyes which are chromium complexes of the monoazo dyes of the formula (V) in which $X_1$ signifies —$NO_2$;

in which formulae II to VI M signifies hydrogen or a cation selected from alkali metal and unsubstituted and substituted ammonium.

20. A process according to claim 18 wherein the dye of formula I', as the free acid, has a molecular weight of 800 to 1000.

21. A process according to claim 16 wherein product (P) is a polymer obtained by reacting diethylenetriamine with dicyandiamide in a molar ratio 1:1.

22. A process according to claim 19 wherein product (P) is a polymer obtained by reacting diethylenetriamine with dicyandiamide in a molar ratio 1:1.

23. A process according to claim 16 wherein product (P), a mixture of products (P) or an acid addition salt of product (P) is applied at a pH of 3 to 6 when applied before the dye and at a pH of 3 to 5 when applied after the dye and in an amount of 0.2 to 5% by weight, calculated as 100% non-protonated active substance, referred to the dry weight of the leather or an amount of 0.1 to 2.5% by weight, calculated as 100non-protonated active substance, referred to the wet weight of the leather.

24. A process according to claim 19 wherein product (P), a mixture of products (P) or an acid addition salt of product (P) is applied at a pH of 3 to 6 when applied before the dye and at a pH of 3 to 5 when applied after the dye and in an amount of 0.2 to 5% by weight, calculated as 100% non-protonated active substance, referred to the dry weight of the leather or an amount of 0.1 to 2.5% by weight, calculated as 100% non-protonated active subsstance, referred to the wet weight of the leather.

25. A process according to claim 19 wherein product (P), a mixture of products (P) or an acid addition salt of product (P) is applied at a pH of 3 to 6 when applied before the dye and at a pH of 3 to 5 when applied after the dye and in an amount of 0.2 to 5% by weight, calculated as 100% non-protonated active substance, referred to the dry weight of the leather or an amount of 0.1 to 2.5% by weight, calculated as 100% non-protonated active substance, referred to the wet weight of the leather.

26. A process according to claim 23 wherein product (P) or a mixture of products (P) or an acid addition salt of product (P) is applied to the leather at a temperature of 25° to 70° C. after the step of applying the dye.

27. A process according to claim 24 wherein product (P) or a mixture of products (P) or an acid addition salt of product (P) is applied to the leather at a temperature of 25° to 70° C. after the step of applying the dye.

28. A process according to claim 13 wherein the polymer obtainable by reacting ($\alpha$) with ($\beta$) is obtained by reacting ($\alpha$) with ($\beta$) in the presence of catalyst $K_1$ which is a (1) salt of a metal of the second or third group of the periodic system of elements with a mineral acid or (2) an amino-substituted pyridine.

29. A process according to claim 16 wherein the polymer obtainable by reacting ($\alpha$) with ($\beta$) is obtained by reacting ($\alpha$) with ($\beta$) in the presence of a catalyst $K_1$ which is (1) an aluminium, barium, magnesium or zinc salt of a mineral acid or (2) a pyridine substituted by a tertiary amino group.

30. A process according to claim 22 where in the product (P) is a polymer obtained by reacting dicyandiamide with diethylenetriamine in the presence of a chloride of aluminium, barium, magnesium or zinc.

31. A process according to claim 1, wherein ($\alpha$) is a polyamine of the formula $$RRN—(Z'—X_2)_tZ'—NRR \quad (VIII)$$

wherein each R independently signifies hydrogen, $C_{1-4}$-alkyl, $C_{1-4}$-alkyl substituted with hydroxy, $C_{1-4}$-alkoxy, phenyl or cyano, t is a number from 0 to 100, each Z' independently signifies a $C_{1-4}$-alkylene or hydroxy-alkylene radical and each $X_2$ signifies —O—, —S— or —NR—, the amine of formula (VIII) containing at least one reactive NH or $NH_2$ group.

32. A process according to claim 13 wherein ($\alpha$) is a polyamine of formula (VIII).

33. A process according to claim 13 wherein the treatment with product (P) is carried out after dyeing or printing.

34. A process according to claim 31 wherein product (P) is a product of the reaction of ($\alpha$) with ($\beta$).

35. A process according to claim 32 wherein product (P) is a product of the reaction of ($\alpha$) with ($\beta$).

36. A process according to claim 34 wherein the treatment with product (P) is carried out after dyeing or printing.

37. A process according to claim 36 wherein ($\beta$) is dicyanodiamide.

38. A process according to claim 16 wherein product (P) is a product of the reaction of ($\alpha$) with ($\beta$).

39. A process according to claim 18 wherein product (P) is a product of the reaction of ($\alpha$) with ($\beta$).

40. A process according to claim 34 wherein, in formula VIII, R is hydrogen, t is a number from 0 to 4, $X_2$ is —NH— or —$NCH_3$— and each Z signifies $C_{2-4}$ alkylene.

41. A process according to claim 35 wherein ($\alpha$) is diethylene triamine, triethylenetetramine, tetraethylene pentamine, 3-(2-aminoethyl)-aminopropylamine, dipropylene triamine or N,N-bis-(3-aminopropyl)-methylamine and ($\beta$) is dicyanodiamide.

* * * * *